US008156904B2

(12) United States Patent
Giannini et al.

(10) Patent No.: US 8,156,904 B2
(45) Date of Patent: Apr. 17, 2012

(54) VARIABLE VOLUME CROSSOVER PASSAGE FOR A SPLIT-CYCLE ENGINE

(75) Inventors: Ambrogio Giannini, Russell, MA (US); Stephen Scuderi, Westfield, MA (US)

(73) Assignee: Scuderi Group, LLC, West Springfield, MA (US)

( * ) Notice: Subject to any disclaimer, the term of this patent is extended or adjusted under 35 U.S.C. 154(b) by 267 days.

(21) Appl. No.: 12/759,783

(22) Filed: Apr. 14, 2010

(65) Prior Publication Data

US 2010/0263646 A1 Oct. 21, 2010

Related U.S. Application Data

(60) Provisional application No. 61/170,343, filed on Apr. 17, 2009.

(51) Int. Cl.
*F02B 75/24* (2006.01)

(52) U.S. Cl. ..... 123/53.5; 123/70 R; 123/184.51

(58) Field of Classification Search ..... 123/70 R, 123/184.51, 184.53, 184.56, 52.2–52.6, 53.5
See application file for complete search history.

(56) References Cited

U.S. PATENT DOCUMENTS

| | | | | |
|---|---|---|---|---|
| 1,389,337 | A * | 8/1921 | Wolfard | 123/68 |
| 1,535,423 | A * | 4/1925 | Latta | 123/69 R |
| 2,033,166 | A | 3/1936 | Winters | |
| 2,161,069 | A | 6/1939 | Maniscalco | |
| 2,594,845 | A * | 4/1952 | Baumann | 60/609 |
| 3,675,630 | A | 7/1972 | Stratton | |
| 4,170,970 | A * | 10/1979 | McCandless | 123/52.4 |
| 4,928,638 | A | 5/1990 | Overbeck | |
| 5,797,365 | A | 8/1998 | Kim | |
| 6,105,545 | A | 8/2000 | Breidenbach | |
| 6,334,606 | B1 | 1/2002 | Tobinai et al. | |

FOREIGN PATENT DOCUMENTS

| | | |
|---|---|---|
| JP | 58148253 | 9/1983 |

* cited by examiner

*Primary Examiner* — Noah Kamen
*Assistant Examiner* — Hung Q Nguyen
(74) *Attorney, Agent, or Firm* — Fildes & Outland, P.C.

(57) ABSTRACT

An engine includes a crankshaft rotatable about a crankshaft axis. A compression piston is slidably received within a compression cylinder and operatively connected to the crankshaft such that the compression piston is operable to reciprocate through an intake stroke and a compression stroke during a single rotation of the crankshaft. An expansion (power) piston is slidably received within an expansion cylinder and operatively connected to the crankshaft such that the expansion piston is operable to reciprocate through an expansion stroke and an exhaust stroke during a single rotation of the crankshaft. A variable volume crossover passage interconnects the compression and expansion cylinders, and includes a variable volume housing to controllably regulate the air flow from the compression cylinder to the expansion cylinder.

11 Claims, 7 Drawing Sheets

VARIABLE VOLUME CROSSOVER PASSAGE FOR A SPLIT-CYCLE ENGINE

CROSS REFERENCE TO RELATED APPLICATION

This application claims the benefit of U.S. Provisional Application No. 61/170,343, filed Apr. 17, 2009.

TECHNICAL FIELD

The present invention relates to internal combustion engines. More specifically, the present invention relates to a split-cycle engine having a variable volume crossover passage.

BACKGROUND OF THE INVENTION

For purposes of clarity, the term "conventional engine" as used in the present application refers to an internal combustion engine wherein all four strokes of the well known Otto cycle (i.e., the intake, compression, expansion and exhaust strokes) are contained in each piston/cylinder combination of the engine. The term split-cycle engine as used in the present application may not have yet received a fixed meaning commonly known to those skilled in the engine art. Accordingly, for purposes of clarity, the following definition is offered for the term "split-cycle engine" as may be applied to engines disclosed in the prior art and as referred to in the present application.

A split-cycle engine as referred to herein comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft; and a crossover passage interconnecting the expansion and compression cylinders, the crossover passage including a crossover compression (XovrC) valve and a crossover expansion (XovrE) valve defining a pressure chamber therebetween.

U.S. Pat. No. 6,543,225 granted Apr. 8, 2003 to Carmelo J. Scuderi (herein the Scuderi patent) and U.S. patent application Ser. No. 12/157,460 filed Jun. 11, 2008 to Ford A. Phillips (herein the Phillips application) contains an extensive discussion of split-cycle and similar type engines. In addition the Scuderi patent and the Phillips application disclose details of prior versions of split-cycle engines of which the present invention comprises a further development. Both the Scuderi patent and the Philips application are incorporated herein in their entirety.

GLOSSARY

The following glossary of acronyms and definitions of terms used herein is provided for reference:

Air/fuel Ratio: The proportion of air to fuel in the intake charge.

Bottom Dead Center (BDC): The piston's farthest position from the cylinder head, resulting in the largest cylinder volume of the cycle.

Crank Angle (CA): The angle of rotation of the crankshaft.

Critical Pressure Ratio: The ratio of pressures which cause the flow through an orifice to achieve sonic velocity, i.e. Mach 1. It can be calculated from the following equation:

$$\frac{p_0}{p_c} = \left(\frac{\gamma+1}{2}\right)^{\frac{\gamma}{\gamma-1}}$$

Where:

$p_c$=critical pressure (at throat)

$p_0$=upstream pressure $\gamma$=specific heat ratio.

For dry air at room temperature $\gamma$=1.4, so the critical pressure ratio is 1.893.

Compression/Expansion Cylinder Displacement Ratio: The ratio of the displacement of the compression cylinder to the expansion cylinder.

Compression Ratio: The ratio of cylinder volume at BDC to that at TDC.

Cylinder Displacement: The volume that the piston displaces from BDC to TDC.

Full (100%) Engine Load: The maximum torque that an engine can produce at a given speed.

Knock: The tendency of a fuel/air mixture to self ignite during compression.

Knock Fraction: A predicted parameter which provides a relative indication of the tendency of a particular fuel/air mixture to reach self ignition during compression. Self ignition is usually denoted by a knock value fraction of 1 while no tendency to self ignite is usually denoted by a knock fraction of zero. For example, a knock fraction of 0.8 indicates that the chemical pre-reactions to self ignition have reached 80% of the value required to generate self-ignition.

Octane (ON): A relative empirical rating of a fuel's resistance to self-ignition during a compression stroke in an internal combustion engine. Octane number (ON) is measured on a scale of 0-120, with 100 octane being a fuel (iso-octane) with high resistance to self ignition, while n-heptane has a high tendency to knock during compression and is assigned a zero (0) octane number.

Power Density: The brake power/engine displacement, usually expressed as kilowatts/liter or horsepower/liter.

Stoichiometric Ratio: The chemically correct mass ratio of air to fuel to ensure that all the fuel is burned (oxidized) and all the oxygen is utilized for that burn.

Top Dead Center (TDC): The closest position to the cylinder head that the piston reaches throughout the cycle, providing the lowest cylinder volume.

Referring to FIGS. 1 and 2, an exemplary embodiment of a prior art split-cycle engine concept, most closely represented by the Philips Application, is shown generally by numeral 10. Engine 10 includes a crankshaft 12 rotatable about a crankshaft axis 14 in a clockwise direction as shown in the drawing. The crankshaft 12 includes adjacent angularly displaced leading and following crank throws 16, 18, connected to connecting rods 20, 22, respectively.

Engine 10 further includes a cylinder block 24 defining a pair of adjacent cylinders, in particular a compression cylinder 26 and an expansion cylinder 28 closed by a cylinder head 30 at one end of the cylinders opposite the crankshaft 12.

A compression piston 32 is received in compression cylinder 26 and is connected to the connecting rod 22 for reciprocation of the piston between top dead center (TDC) and bottom dead center (BDC) positions. An expansion piston 34 is received in expansion cylinder 28 and is connected to the connecting rod 20 for similar TDC/BDC reciprocation.

In this embodiment the expansion piston 34 leads the compression piston 32 by 20 degrees crank angle. In other words, the compression piston 32 reaches its TDC position 20 degrees of crankshaft rotation after the expansion piston 34 reaches its TDC position. The diameters of the cylinders and pistons and the strokes of the pistons and their displacements need not be the same.

The cylinder head 30 provides the structure for gas flow into, out of and between the cylinders 26, 28. In the order of gas flow, the cylinder head includes an intake port 36 through which intake air is drawn into the compression cylinder 26, a pair of separate crossover (Xovr) passages (or ports) 38 and 39 through which compressed air is transferred from the compression cylinder 26 to the expansion cylinder 28, and an exhaust port 40 through which spent gases are discharged from the expansion cylinder.

Even though a pair of Xovr passages, 38 and 39, are disclosed in the exemplary embodiment of engine 10, one skilled in the art would recognize that one or more crossover passages may be utilized in split-cycle engine 10.

Gas flow into the compression cylinder 26 is controlled by an inwardly opening poppet type intake valve 42. Gas flow into and out of each crossover passage 38 and 39 is controlled by a pair of outwardly opening poppet valves, i.e., crossover compression (XovrC) valves 46 at inlet ends of the Xovr passages 38, 39 and crossover expansion (XovrE) valves 48 at outlet ends of the crossover passages 38, 39. Exhaust gas flow out of the exhaust port 40 is controlled by an inwardly opening poppet type exhaust valve 54. These valves 42, 46, 48 and 54 may be actuated in any suitable manner such as by mechanically driven cams, variable valve actuation technology or the like.

Each crossover passage 48, 49 has at least one high pressure fuel injector 56 disposed therein. The fuel injectors 56 are operative to inject fuel into a charge of compressed air within the crossover passages 38, 39 entirely during the compression stroke.

Engine 10 also includes one or more spark plugs 58 or other ignition devices located at appropriate locations in the end of the expansion cylinder wherein a mixed fuel and air charge may be ignited and burned during the expansion stroke.

Additionally, the engine 10 is desirably provided with a boosting device, such as a turbocharger 60, capable of raising cylinder intake charge pressures up to and beyond 1.7 bar, in order to take full advantage of the knock resistant features of the split-cycle engine as discussed in greater detail herein. Turbocharger 60 includes an exhaust turbine 62 driving a rotary compressor 64. The turbine has an exhaust gas inlet 66 connected to receive pressurized exhaust gas from the exhaust port 40 of the engine 10. The turbine 62 drives a compressor 64, which draws in ambient air through an air inlet 68 and discharges pressurized air through a compressed air outlet 70. The compressed air passes through a single stage intercooler 72 and enters the air intake port 36 at an absolute pressure of at least 1.7 bar at full load.

Knocking in an engine is a function of the amount of time fuel is exposed to excessive temperatures before ignition occurs. Therefore, features that reduce the temperature or time that fuel is exposed to excessive temperatures within an engine will increase the engine's resistance to knock.

A feature of split-cycle engine 10 which contributes to knock prevention, or higher knock resistance than that of a conventional engine, is the heat loss through Xovr passages 38 and 39. High temperature air in the Xovr passages 38 and 39 lowers the charge air temperature and therefore increases resistance to knock.

The compressed air in the crossover (Xovr) passages 38 and 39 of the split-cycle engine 10 loses energy by heat transfer to the passage wall surfaces, as the compression raises the temperature of the air well above passage wall temperatures. Although this energy loss reduces efficiency, it aids in preventing fuel self-detonation ("knock") in the Xovr passages 38 and 39 and expansion cylinder 28 prior to spark ignition, as the heat loss lowers the compressed air temperature.

In a conventional gasoline engine, the level of increased air pressure produced by higher compression ratios, supercharging or turbocharging is limited by the tendency to produce knock at the increased air temperatures. This tendency can be reduced by passing the air through an intercooler, after compression by the supercharger or turbocharger. However, after cylinder compression, the air is still at a very increased temperature, and fuel injection has already occurred. With the split-cycle engine 10, an intercooler 72 can also be used after supercharging or turbocharging, but in addition, the unique feature of the split-cycle engine 10 is that air is cooled again after cylinder compression due to the heat loss in the Xovr passages 38 and 39, and fuel injection occurs during the latter portion of that compression.

Problematically however, as the air temperature in the Xovr passages 38 and 39 falls, so does the air pressure, since the volume in the Xovr passages 38 and 39 remains constant. As the pressure falls, the efficiency also falls and will soon reach a point where the disadvantages of lower efficiency will become greater than the advantages of higher knock resistance.

Accordingly, there is a need to have a variable volume Xovr passage. More specifically, there is a need to vary the volume within the crossover passage of a prior art split-cycle engine 10 as the air temperature is cooled in order to maintain pressure within the crossover passages 78 and 79 and to further increase the split-cycle engine's resistance to knock with minimal sacrifice in efficiency.

SUMMARY OF THE INVENTION

The present invention provides a solution to the aforementioned crossover passage pressure problems for split-cycle engines particularly operating at part-load. In particular, the present invention generally solves these problems by providing a variable volume crossover passage that is operable to maintain air pressure in the crossover passage and thereby regulate air temperature and control pre-ignition which is significantly useful while operating the engine under part-load conditions.

These and other advantages may be accomplished in an exemplary embodiment of the present invention by providing a split-cycle engine, which comprises a crankshaft rotatable about a crankshaft axis, a compression piston slidably received within a compression cylinder and operatively connected to the crankshaft such that the compression piston is operable to reciprocate through an intake stroke and a compression stroke during a single rotation of the crankshaft and an expansion (power) piston slidably received within an expansion cylinder and operatively connected to the crankshaft such that the expansion piston is operable to reciprocate through an expansion stroke and an exhaust stroke during a single rotation of the crankshaft. A variable volume crossover passage interconnects the compression and expansion cylinders and includes a variable volume housing to controllably regulate the air flow from the compression cylinder to the expansion cylinder, whereby regulating the air flow from the compression cylinder to the expansion cylinder regulates the air pressure.

The variable volume crossover passage includes an adjustable partition operative within the passage to restrict air flow through the passage. The crossover passage includes a housing having a recess for receiving the partition in a retracted open crossover disposition of the partition. A regulator is provided for regulating the position of the adjustable partition within the passage. The regulator may be a stepper motor operatively connected to the adjustable partition, a spring operatively connected to the adjustable partition or an air spring operatively connected to the adjustable partition.

An air delivery system for delivering air to the air spring comprises an air input line and an air cooler, air filter and air dryer successively disposed on the air delivery line for respectively treating air communicated to the air spring.

The adjustable partition may be a bladder or a moveable plate.

A method for regulating the air flow within a crossover passage of a split-cycle engine from the compression cylinder to the expansion cylinder to regulate the air pressure entering the expansion cylinder comprises the steps of controllably varying the volume within the crossover passage.

These and other features and advantages of the invention will be more fully understood from the following detailed description of the invention taken together with the accompanying drawings.

DETAILED DESCRIPTION OF THE INVENTION

Figure 1:
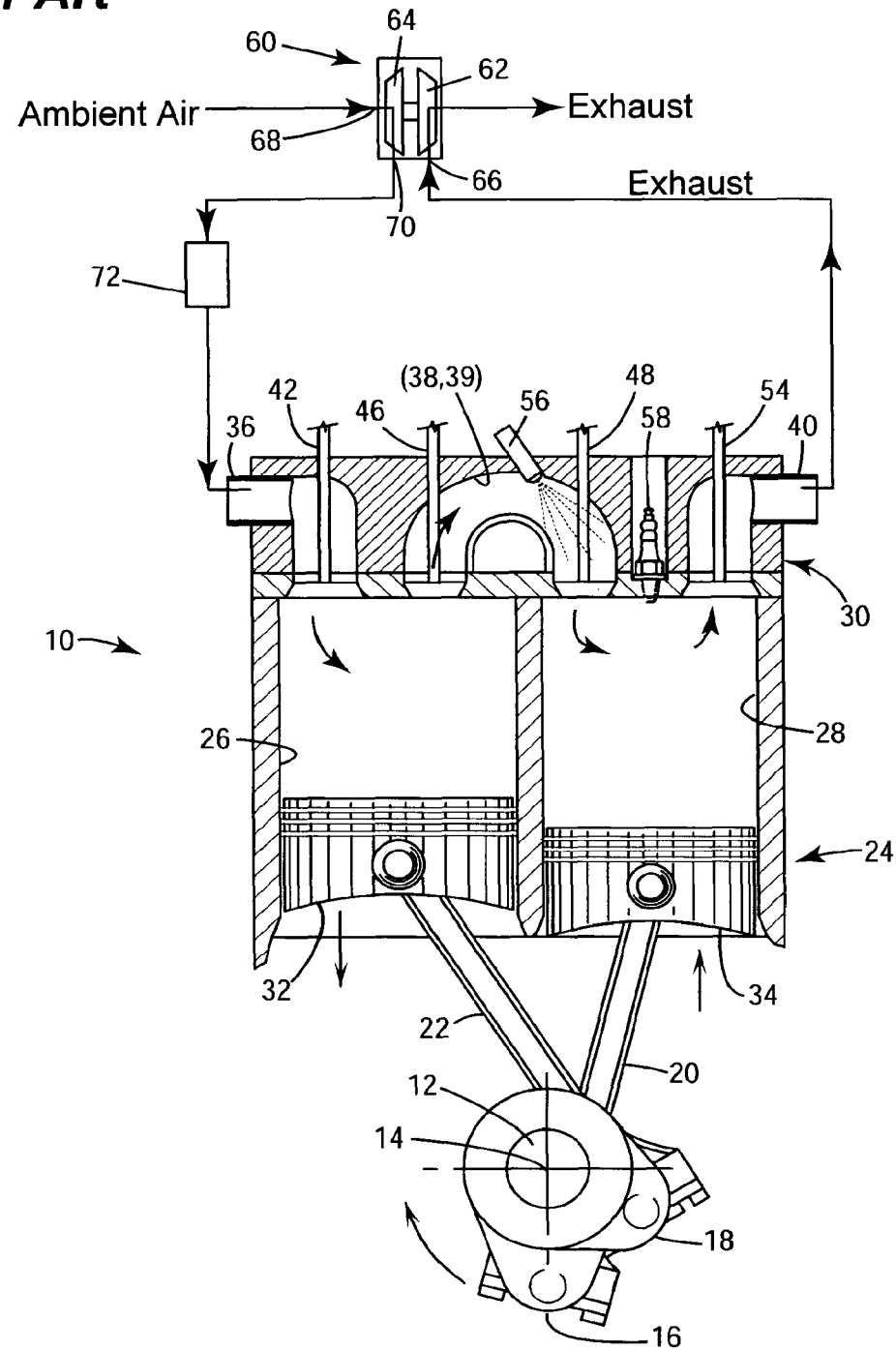
FIG. 1 Prior Art
FIG. 1 is a transverse cross-sectional view of a prior art split-cycle engine with a turbocharger.
Figure 2:
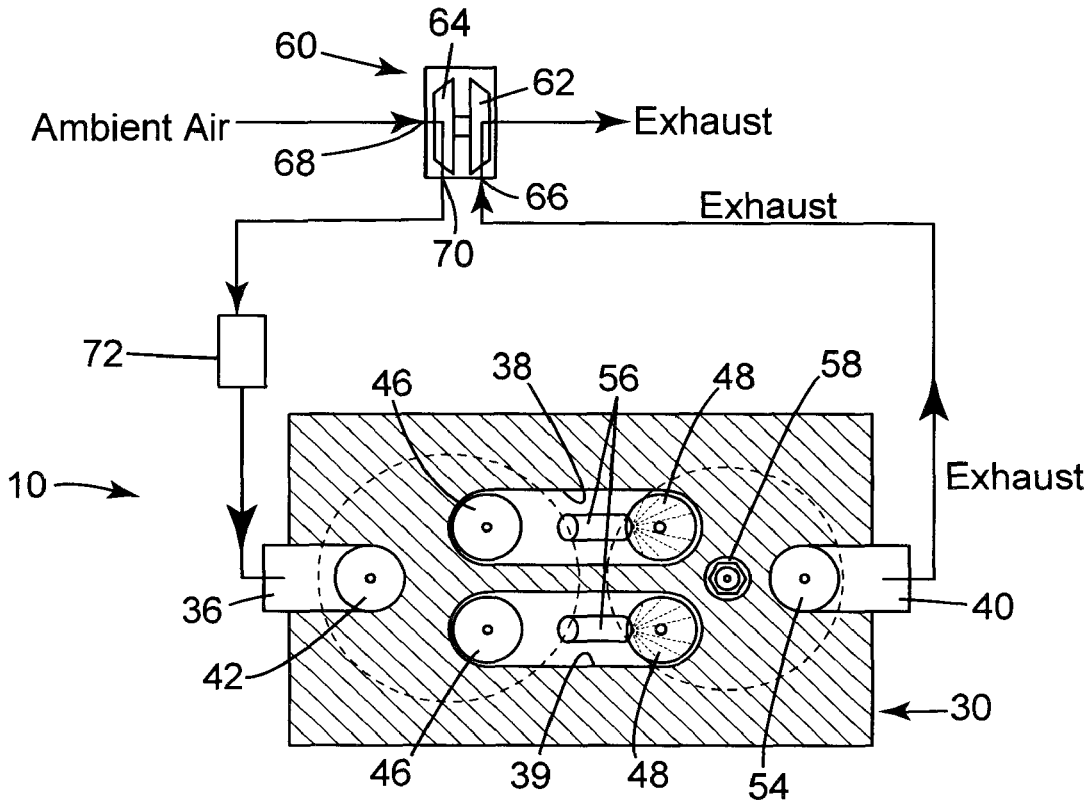
FIG. 2 Prior Art
FIG. 2 is a transverse top view of the prior art split-cycle engine of FIG. 1.
Figure 3:
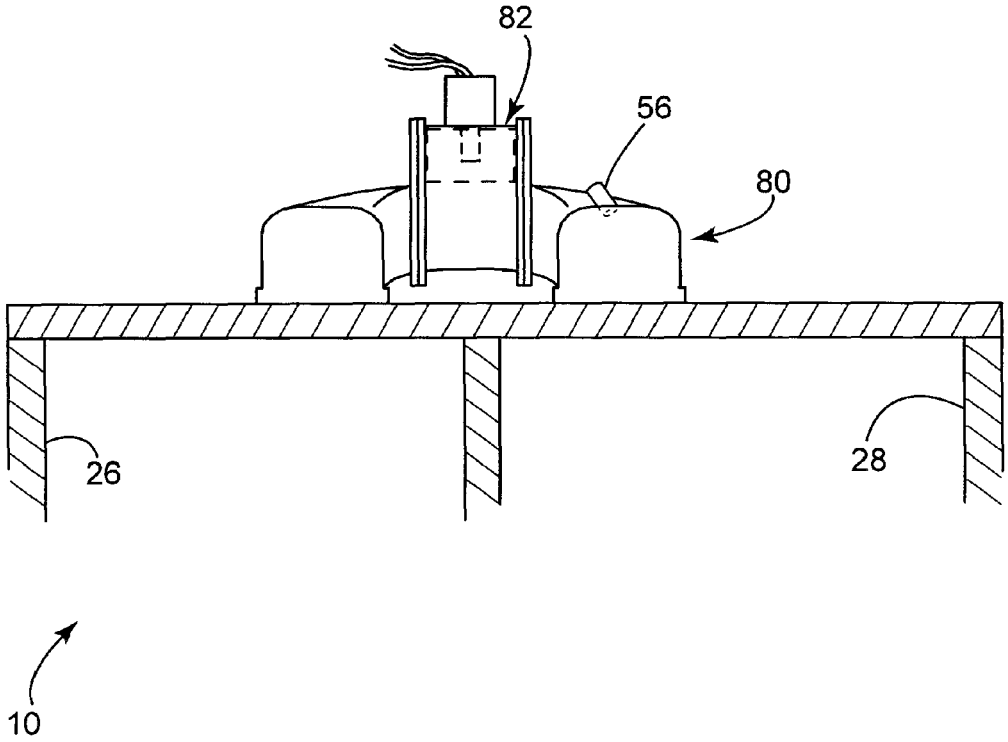
FIG. 3 is an exemplary embodiment of a cross sectional view of a variable volume crossover passage in accordance with the present invention.

Referring now to FIG. 3 of the drawings in detail, numeral 80 generally indicates an exemplary embodiment of a variable volume crossover passage interconnecting the compression cylinder 26 and expansion cylinder 28 of a split-cycle engine 10. The variable volume crossover passage 80 includes a variable volume housing 82.

Figure 4:
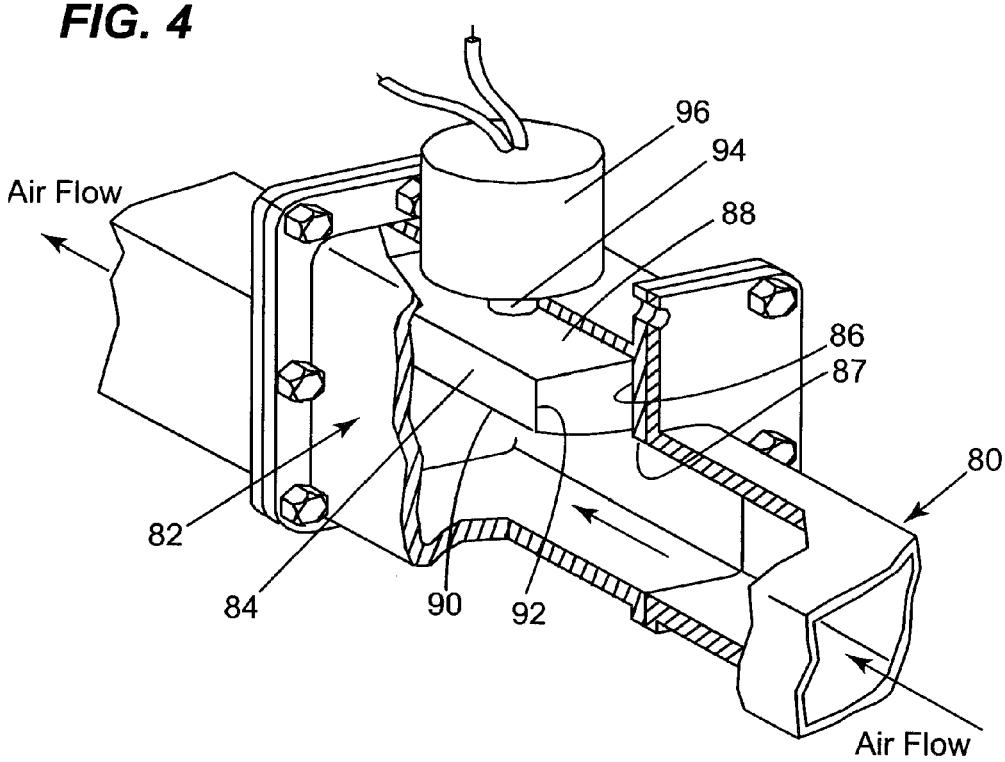
FIG. 4 is a perspective sectioned view of the variable volume crossover passage of FIG. 3 in its fully retracted position.
Figure 5:
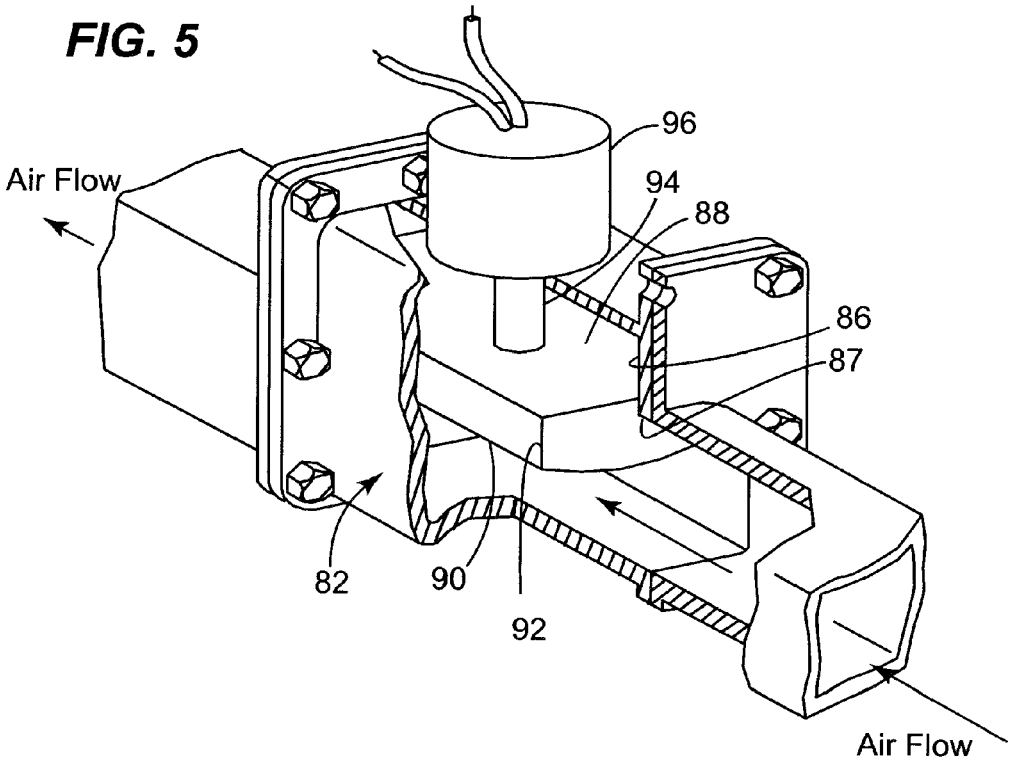
FIG. 5 is a perspective sectioned view of the variable volume crossover passage of FIG. 3 in its fully extended position.

Referring to FIGS. 4 and 5, the variable volume housing 82 is shown in a sectioned perspective view illustrating an adjustable partition 84 in both fully retracted and fully extended positions respectively. The specific embodiment of this housing 82 is shown connected within the variable volume crossover passage 80. The adjustable partition 84 therein is sized to slidably fit into a recess 86 having a lower edge 87 of the housing 82. The partition 84 can be one of several designs, including, but not limited to, a flexible bladder or a solid plate. In the illustrated embodiment, the partition 84 is a solid plate that has an upper surface 88, a lower surface 90 and a peripheral edge 92. The upper surface 88 is attached to a rotatable threaded shaft 94 that is operatively connected to a stepper motor 96.

As shown specifically in FIG. 4, when the partition 84 is in its fully retracted position, the shaft 94 is fully retracted and the entire plate fits substantially into the recess 86 such that the crossover passage 80 is fully open and at its largest volume. As shown in FIG. 5, when the partition 84 is in its fully extended position, the shaft 94 is fully extended and the lower surface 90 and a substantial portion of the peripheral edge 92 extends beyond the lower edge 87. In the fully extended position, crossover passage 80 is at its lowest volume due to the added restriction of the partition 84 extending into the crossover passage 80. However, the upper surface 88 of the plate still fits within the recess 86 and above the lower edge 87 of the recess 86. The stepper motor 96 is capable of positioning the partition 84 in any position between fully extended (FIG. 5) and fully retracted (FIG. 4)

Figure 6:
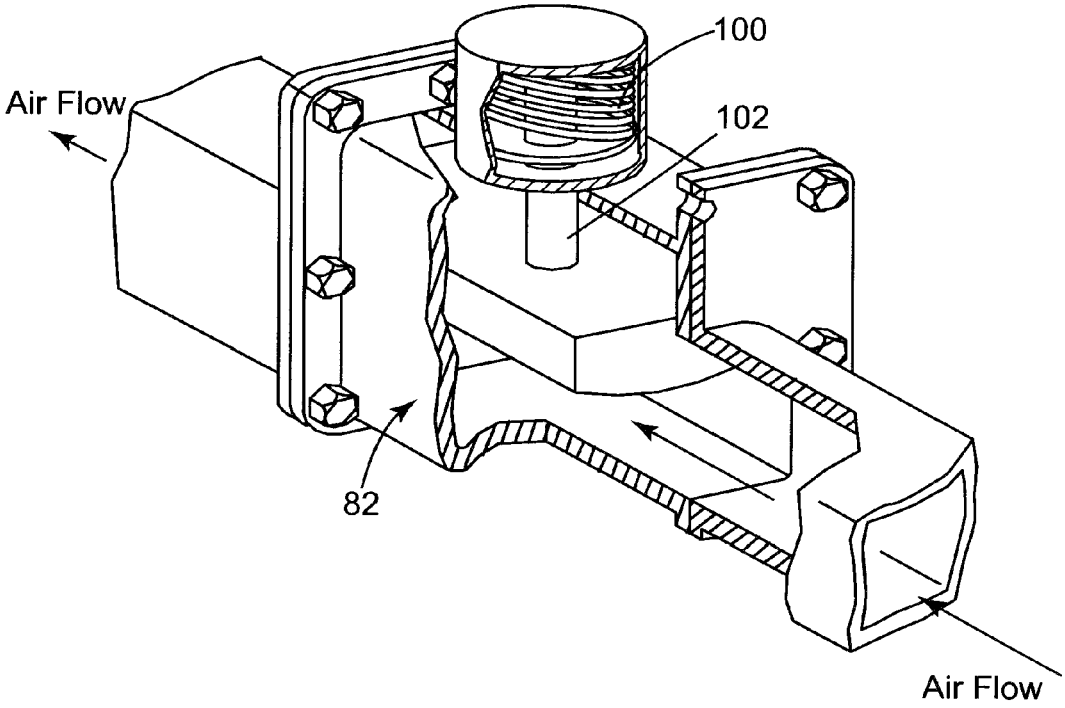
FIG. 6 is a perspective sectioned view of an alternative embodiment of the variable volume crossover passage utilizing a mechanical spring in accordance with the present invention.

Referring to FIG. 6, an alternative exemplary embodiment is shown, wherein the stepper motor 96 is replaced with a simple mechanical spring 100 connected to a straight shaft 102 that is operatively connected to the partition 84.

Figure 7:
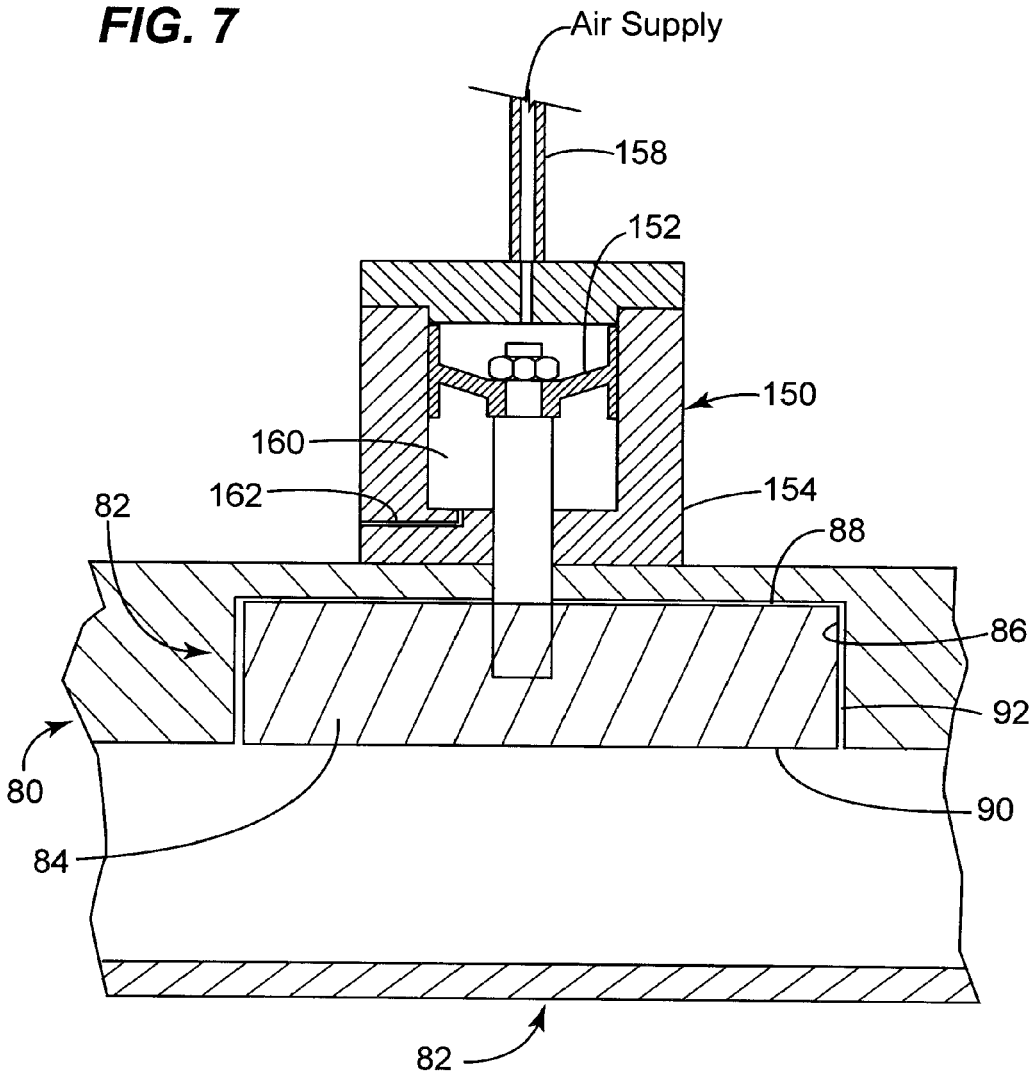
FIG. 7 is a perspective sectioned view of another alternative embodiment of the variable volume crossover passage utilizing an air spring in accordance with the present invention.

Referring to FIG. 7, another alternative embodiment is shown wherein the mechanical spring 100 is replaced with an air spring 150. Additionally, the variable volume housing 82 in this embodiment is an integral part of the variable volume crossover passage 80. One skilled in the art will also recognize that there are alternative designs for incorporating the housing 82 into the crossover passage 80, for example via welding, threading or the like.

The air spring 150 includes an air spring piston 152 slidably received in an air spring chamber 154. The air spring piston 152 divides the air spring chamber 154 into a pressurized (or upper) compartment 156, which is connected to an air supply line 158, and a depressurized (or lower) compartment 160, which is open to the atmosphere (or a low pressure sink) through low pressure line 162. As before, the lower end of the straight shaft 102 is fastened to the upper surface 88 of the partition 84 which, in turn, slidably fits within recess 86.

Figure 8:
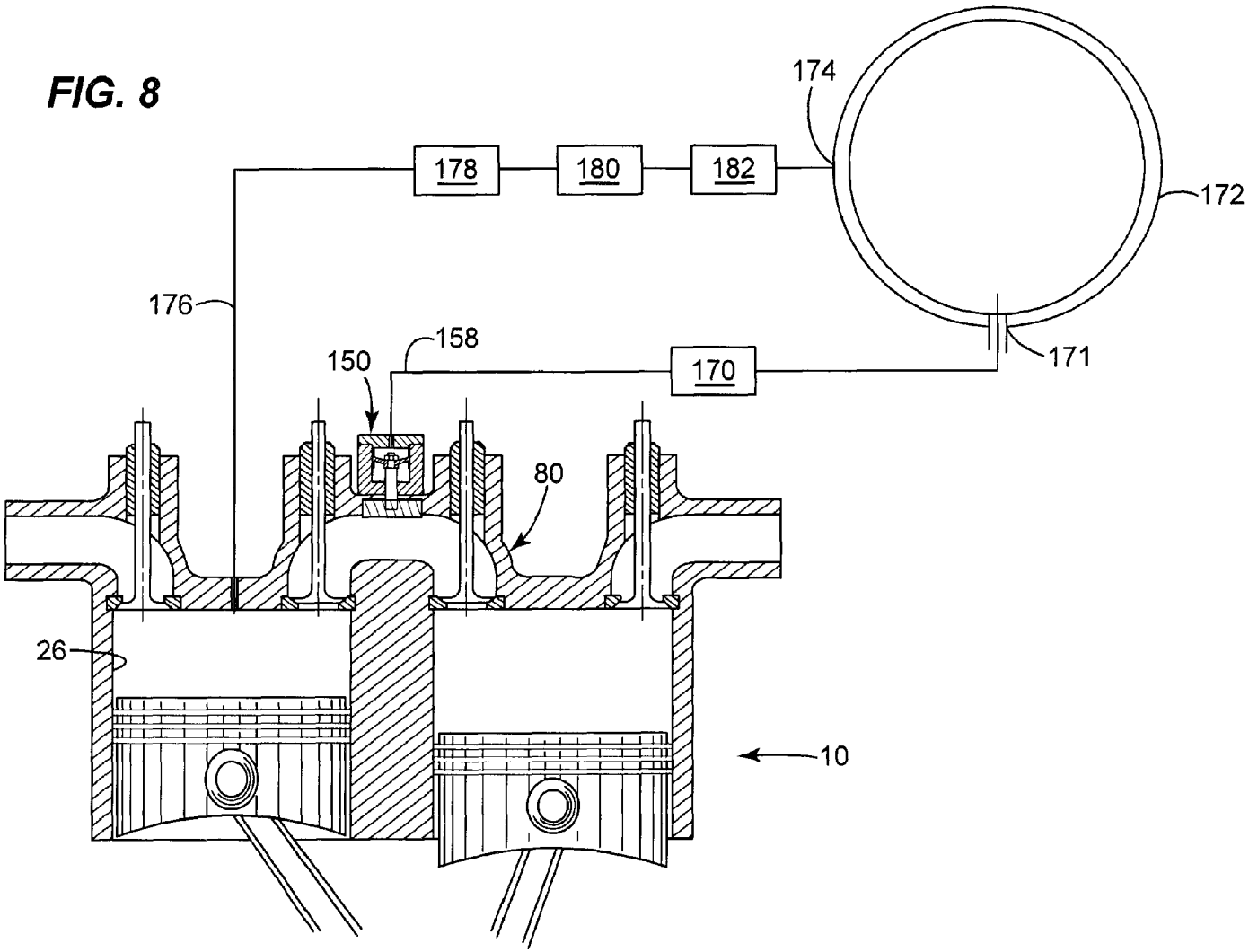
FIG. 8 is a cross sectional view of a split-cycle engine having a system to properly condition the air feeding the air spring of the variable volume crossover passage of FIG. 7.

Referring to FIG. 8, the air supply line 158 is connected to an air pressure regulator 170, which is connected to the outlet end 171 of an air accumulator 172. The compression cylinder 26 and compression piston 32 of engine 10 may deliver compressed air to the input end 174 of accumulator 172 via air input line 176. In order to properly condition the pressurized input air into accumulator 172 from compression cylinder 26, the air input line is run successively through air cooler 178, air filter 180, and air dryer 182.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. An engine, comprising:

a crankshaft rotatable about a crankshaft axis;

a compression piston slidably received within a compression cylinder and operatively connected to the crankshaft such that the compression piston is operable to reciprocate through an intake stroke and a compression stroke during a single rotation of the crankshaft;

an expansion (power) piston slidably received within an expansion cylinder and operatively connected to the crankshaft such that the expansion piston is operable to reciprocate through an expansion stroke and an exhaust stroke during a single rotation of the crankshaft; and a variable volume crossover passage interconnecting the compression and expansion cylinders, said crossover passage including a variable volume housing to controllably regulate the air flow from the compression cylinder to the expansion cylinder;

whereby regulating the air flow from the compression cylinder to the expansion cylinder regulates the air pressure.

2. The engine of claim 1, wherein said variable volume crossover passage includes an adjustable partition operative within the passage to restrict air flow through the passage.

3. The engine of claim 2, wherein said variable volume crossover passage includes a housing having a recess for receiving the partition in a retracted open crossover disposition of the partition.

4. The engine of claim 2, including a regulator for regulating the position of the adjustable partition within the passage.

5. The engine of claim 4, wherein said regulator is a stepper motor operatively connected to said adjustable partition.

6. The engine of claim 4, wherein said regulator is a spring operatively connected to said adjustable partition.

7. The engine of claim 4, wherein said regulator is an air spring operatively connected to said adjustable partition.

8. The engine of claim 7, including an air delivery system for delivering air to said air spring, said air delivery system comprising an air input line and an air cooler, air filter and air dryer successively disposed on said air delivery line for respectively treating air communicated to said air spring.

9. The engine of claim 2, wherein said said adjustable partition is a bladder.

10. The engine of claim 2, wherein said adjustable partition is a moveable plate.

11. A method for regulating the air flow within the crossover passage of the engine according to claim 1 from the compression cylinder to the expansion cylinder to regulate the air pressure entering the expansion cylinder, the method comprising the step of controllably varying the volume of the crossover passage.

* * * * *